US009013095B1

(12) United States Patent
Hayashi

(10) Patent No.: US 9,013,095 B1
(45) Date of Patent: Apr. 21, 2015

(54) SPARK PLUG FOR INTERNAL COMBUSTION ENGINE

(71) Applicant: Denso Corporation, Kariya, Aichi-pref. (JP)

(72) Inventor: Kosuke Hayashi, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/533,417

(22) Filed: Nov. 5, 2014

(30) Foreign Application Priority Data

Nov. 6, 2013 (JP) ..... 2013-230421

(51) Int. Cl.

| | |
|---|---|
| ***H01T 13/20*** | (2006.01) |
| ***H01T 13/32*** | (2006.01) |
| ***H01T 13/16*** | (2006.01) |
| ***H01T 13/04*** | (2006.01) |

(52) U.S. Cl.
CPC ..... *H01T 13/32* (2013.01); *H01T 13/16* (2013.01); *H01T 13/04* (2013.01)

(58) Field of Classification Search
CPC ..... H01T 13/32; H01T 13/16; H01T 13/04; H01T 13/34
See application file for complete search history.

(56) References Cited

FOREIGN PATENT DOCUMENTS

JP H01-279588 11/1989

*Primary Examiner* — Donald Raleigh
(74) *Attorney, Agent, or Firm* — Nixon & Vanderhye PC

(57) ABSTRACT

A spark plug for an internal combustion engine includes a center electrode, an insulator holding the center electrode inserted therein, a housing holding the insulator inserted therein, a ground electrode joined to the housing so as to form a spark discharge gap with the center electrode, and a stem electrically connected to the center electrode. The stem includes a stem body inserted and held inside the insulator and a terminal exposed from a proximal end of the insulator. The insulator includes a supported portion axially supported by the housing. A heat insulating member is interposed between the stem and the center electrode. A conductive member is disposed inside the insulator so as to pass through the heat insulating member for making electrical connection between the stem and the center electrode. The heat insulating member is located closer to a proximal side of the insulator than the supported portion is.

3 Claims, 6 Drawing Sheets

SPARK PLUG FOR INTERNAL COMBUSTION ENGINE

This application claims priority to Japanese Patent Application No. 2013-230421 filed on Nov. 6, 2013, the entire contents of which are hereby incorporated by reference.

BACKGROUND OF THE INVENTION

1. Field of the Invention

The present invention relates to a spark plug for an internal combustion engine of an automobile and the like.

2. Description of Related Art

A spark plug is used for igniting a fuel-air mixture introduced into a combustion chamber of an internal combustion engine of an automobile and the like. The spark plug described in Japanese Patent Application Laid-open No. H1-279588 includes a center electrode, an insulator holding the center electrode inserted therein, a housing holding the insulator inserted therein, and a ground electrode joined to the housing so as to form a spark discharge gap with the center electrode. A stem electrically connected to the center electrode is inserted into the insulator from the proximal side of the insulator opposite to the side of the center electrode (the distal side). To electrically connect the spark plug to an ignition coil, the proximal end portion of the insulator (the insulator head portion) is fitted to a rubber plug cap.

However, the above described spark plug has a problem as described below. There has been a growing trend to employ supercharging or increase compression ratio of an internal combustion engine for the purpose of increasing fuel economy of the engine. As a result, the temperatures of combustion chambers tend to increase. When the temperature of a combustion chamber to which the distal end portion of the spark plug is exposed increases, since an amount of heat transferring from the distal end portion of the center electrode to the stem increases, the temperature of the insulator head portion easily increases. In this case, the rubber plug cap to which the insulator head portion is fitted undergoes heat deterioration easily.

SUMMARY

An exemplary embodiment provides a spark plug for an internal combustion engine including:

a center electrode;

an insulator holding the center electrode inserted therein;

a housing holding the insulator inserted therein;

a ground electrode joined to the housing so as to form a spark discharge gap with the center electrode; and a stem electrically connected to the center electrode, the stem including a stem body inserted and held inside the insulator and a terminal disposed at a proximal end of the stem body and exposed from a proximal end of the insulator;

wherein the insulator includes a supported portion axially supported by the housing;

a heat insulating member is interposed between the stem and the center electrode within the insulator, a conductive member is disposed inside the insulator so as to pass through the heat insulating member for making electrical connection between the stem and the center electrode, and the heat insulating member is located closer to a proximal side of the insulator than the supported portion is.

According to the exemplary embodiment, there is provided a spark plug for an internal combustion engine, which is capable of preventing the temperature of its insulator head portion from increasing excessively.

Other advantages and features of the invention will become apparent from the following description including the drawings and claims.

PREFERRED EMBODIMENTS OF THE INVENTION

Figure 1:
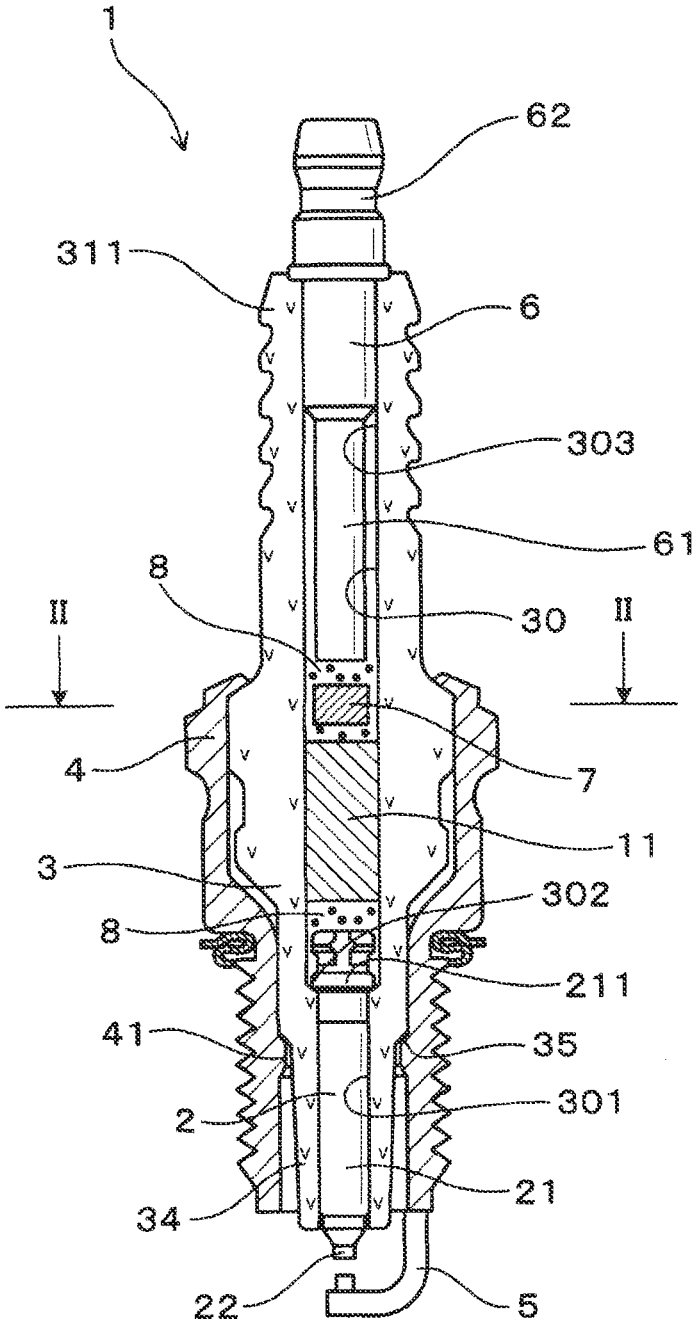
FIG. 1 is an elevation in section of a spark plug for an internal combustion engine according to a first embodiment of the invention.

In the below described embodiments, the side at which a spark plug is inserted into a combustion chamber of an internal combustion engine is referred to as the distal side, and the other side is referred to as the proximal side. In the below described embodiments, the same or equivalent parts or portions are indicated by the same reference numerals.

First Embodiment

Figure 2:
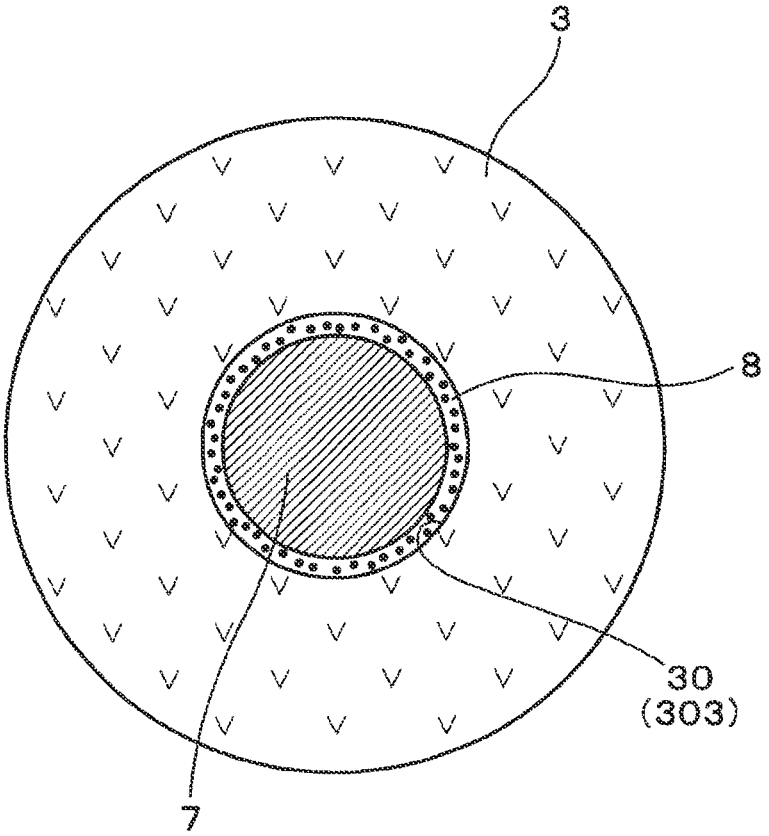
FIG. 2 is a cross-sectional view taken along line II-II of FIG. 1 excluding a housing.

A spark plug 1 for an internal combustion engine according to a first embodiment of the invention is descried with reference to FIGS. 1 and 2. As shown in FIG. 1, the spark plug 1 includes a center electrode 2, an insulator 3 holding the center electrode 2 inserted therein, a housing 4 holding the insulator 3 inserted therein, and a ground electrode 5 joined to the housing 4 so as to form a spark discharge gap with the center electrode 2. The spark plug 1 also includes a stem 6. The stem 6 includes a stem body 61 inserted and held inside the insulator 3, and a terminal 62 provided in the proximal end portion of the stem body 61 so as to project from the proximal end of the insulator 62. The stem 6 is electrically connected with the center electrode 2.

The insulator 3 includes a supported portion 35 which is axially supported by the housing 4. A heat insulating member 7 is interposed between the center electrode 2 and the stem 6 within the insulator 3. As shown in FIGS. 1 and 2, a conductive member 8 for electrically connecting the stem 6 to the center electrode 2 is disposed inside the insulator 3 so as to pass through the heat insulating member 7. As shown in FIG. 1, the heat insulating member 7 is disposed closer to the proximal side than the supported portion 35 is.

Each of the housing 4 and the insulator 3 is formed in a cylindrical shape. The housing 4 is formed with a supporting portion 41 having a circular shape projecting inward at its inner periphery. The supported portion 35 of the insulator 3 is formed in a circular shape projecting outward at the proximal side of a leg portion 34 thereof. The supported portion 35 of the insulator 3 abuts on the proximal end surface of the supporting portion 41 so that the insulator 3 is axially positioned relative to the housing 4. A heat conductive ring member may be interposed between the supporting portion 41 and the supported portion 35. The housing 4 is made of ferroalloy, for example. The insulator is made of alumina ($Al_2O_3$), for example.

The insulator 3 having a cylindrical shape is formed with an axial hole 30 penetrating in the direction of its axis. The axial hole 30 includes a distal hole portion 301 which opens to the distal side and a proximal hole portion 303 which opens to the proximal side. The proximal hole portion 303 is larger in diameter than the distal hole portion 301. A step portion 302 is formed between the proximal hole portion 303 and the distal hole portion 301. The step portion 302 is located closer to the proximal side than the supported portion 35 of the insulator 3 is.

The center electrode 2 includes an electrode matrix 21 formed in a columnar shape and a noble metal chip 22 joined to the distal end of the electrode matrix 21. The electrode matrix 21 includes an expanded diameter portion 211 at its distal end portion. The electrode matrix 21 is made of Ni alloy or the like. The noble metal chip 22 is made of noble metal such as iridium and platinum, or an alloy of them.

The center electrode 2 is disposed in the distal hole portion 301 of the insulator 3 such that its distal end portion (the noble metal chip) projects from the distal end of the insulator 3. The expanded diameter portion 211 provided in the proximal end portion of the electrode matrix 21 abuts on the step portion 302 of the insulator 3 at the proximal side so that the center electrode 2 is axially positioned relative to the insulator 3.

The stem 6 is inserted in the distal end portion (distal hole portion 303) of the axial hole 30 of the insulator 3. The stem 6 includes a stem body 61 inserted and held inside the insulator 3, and the terminal 62 exposed from the insulator 3 at the proximal side of the stem body 61 and connected to the ignition coil. The stem 6 is made of ferroalloy, for example.

A resistor 11 is disposed between the stem 6 and the center electrode 2 for suppressing ignition noise in the spark plug 1. The resister 11 is formed by heating and sealing a resistor composite containing at least resistor material such as carbon or ceramic powder and glass powder. Alternatively, a cartridge resistor may be inserted between the stem 6 and the center electrode 2. The conductive member 8 makes electrical connection between the stem 6 and the resistor 11 and between the resistor 11 and the center electrode 2. The conductive member 8 is made of copper glass, and deposited to the inner periphery of the axial hole 30 of the insulator 3.

The heat insulating member 7 is disposed between the stem 6 and the resistor 11. That is, the heat insulating member 7 is embedded in the conductive member 8 between the stem 6 and the resistor 11. The heat insulating member 7 is located closer to the proximal side than the supported portion 35 of the insulator 3 is. As shown in FIGS. 1 and 2, the diameter of the heat insulating member 7 is smaller than that of the proximal hole portion 303. That is, the heat insulating member 7 does not abut on the entire inner periphery of the axial hole 30 of the insulator 3, and the conductive member 8 is disposed also in the gap between the heat insulating member 7 and the insulator 3. In this embodiment, the heat insulating member 7 is made of zirconia ($ZrO_2$). However, it may be made of slumina or silicon nitride ($Si_3N_4$). Further, the heat insulating member 7 may be liquid such as silicone oil. The thermal conductivity of the heat insulating member 7 is lower than that of any of the center electrode 2, the stem 6, the conductive member 8 and the resistor 11.

The spark plug 1 described above provides the following advantages. The heat insulating member 7 is disposed between the stem 6 and the center electrode 2 within the insulator 3. This makes it possible to reduce the heat transferring from the center electrode 2 to the stem 6. As a result, since the heat transferring from the stem 6 to the proximal end portion (insulator head portion 311) can be reduced, the temperature of the insulator head portion 311 can be prevented from increasing excessively.

Inside the insulator 3, there is disposed the conductive member 8 passing by the heat insulating member 7. This ensures electrical connection between the stem 6 and the center electrode 2.

The heat insulating member 7 is located closer to the proximal side than the supported portion 35 of the insulator 3 is. This makes it possible to prevent the length of the heat transfer path passing through the insulator 3 which is low in thermal conductivity compared to the center electrode 2 and the housing 4 from becoming long excessively. As a result, the temperature of the center electrode 2 can be prevented from increasing excessively.

Second Embodiment

Figure 3:
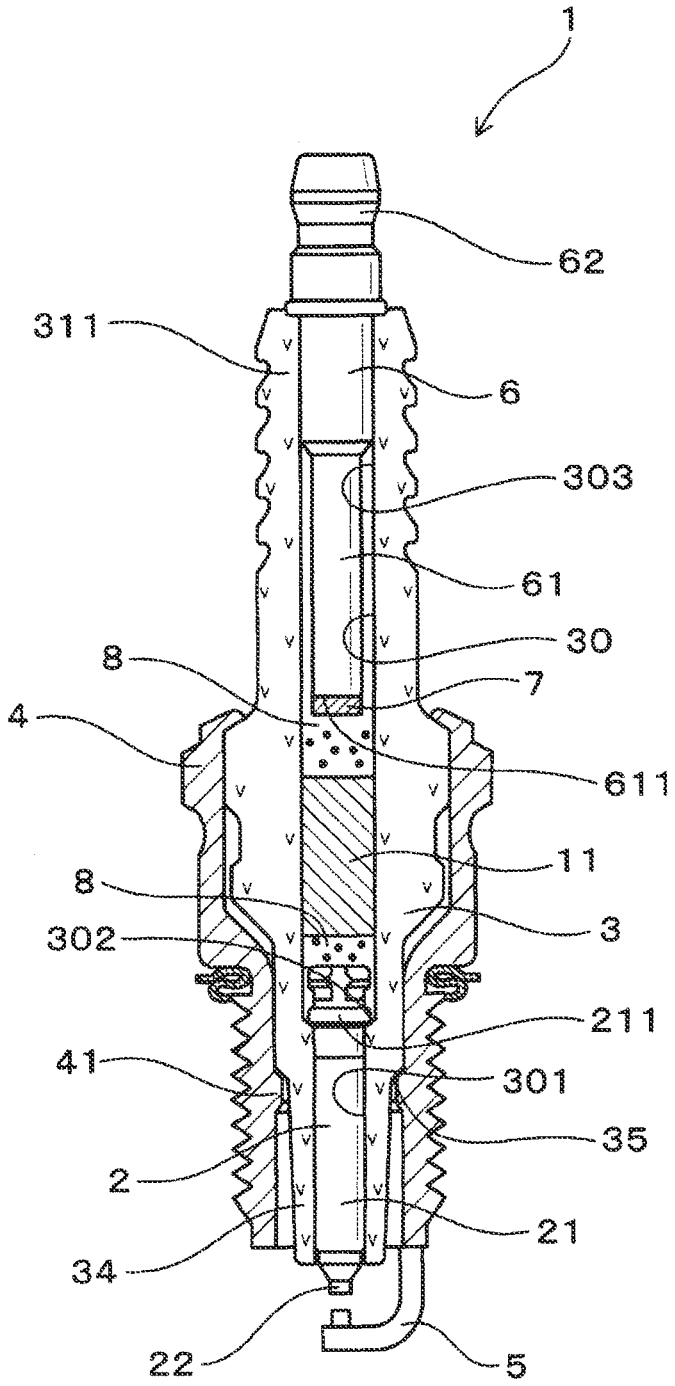
FIG. 3 is an elevation in section of a spark plug for an internal combustion engine according to a second embodiment of the invention.

Next, a second embodiment of the invention is described with reference to FIG. 3. As shown in FIG. 3, the second embodiment differs from the first embodiment in that the heat insulating member 7 is formed on the distal end surface 611 of the stem body 61. The heat insulating member 7 can be formed by coating the distal end surface 611 of the stem body 61 with a heat insulating material, for example. In this embodiment, the heat insulating member 7 is formed only in the distal end surface 611 of the stem body 61. However, the heat insulating member 7 may be formed also on the peripheral side of the stem body 61.

The spark plug 1 according to the second embodiment can be manufactured easily with less man hours, because the heat insulating member 7 can be positioned in place within the spark plug 1 by inserting the stem 6 formed with the heat insulating member 7 at the distal end surface 611 of the system body 61 into the insulator 3. Other than the above, the second embodiment provides the same advantages as those provided by the first embodiment.

Third Embodiment

Figure 4:
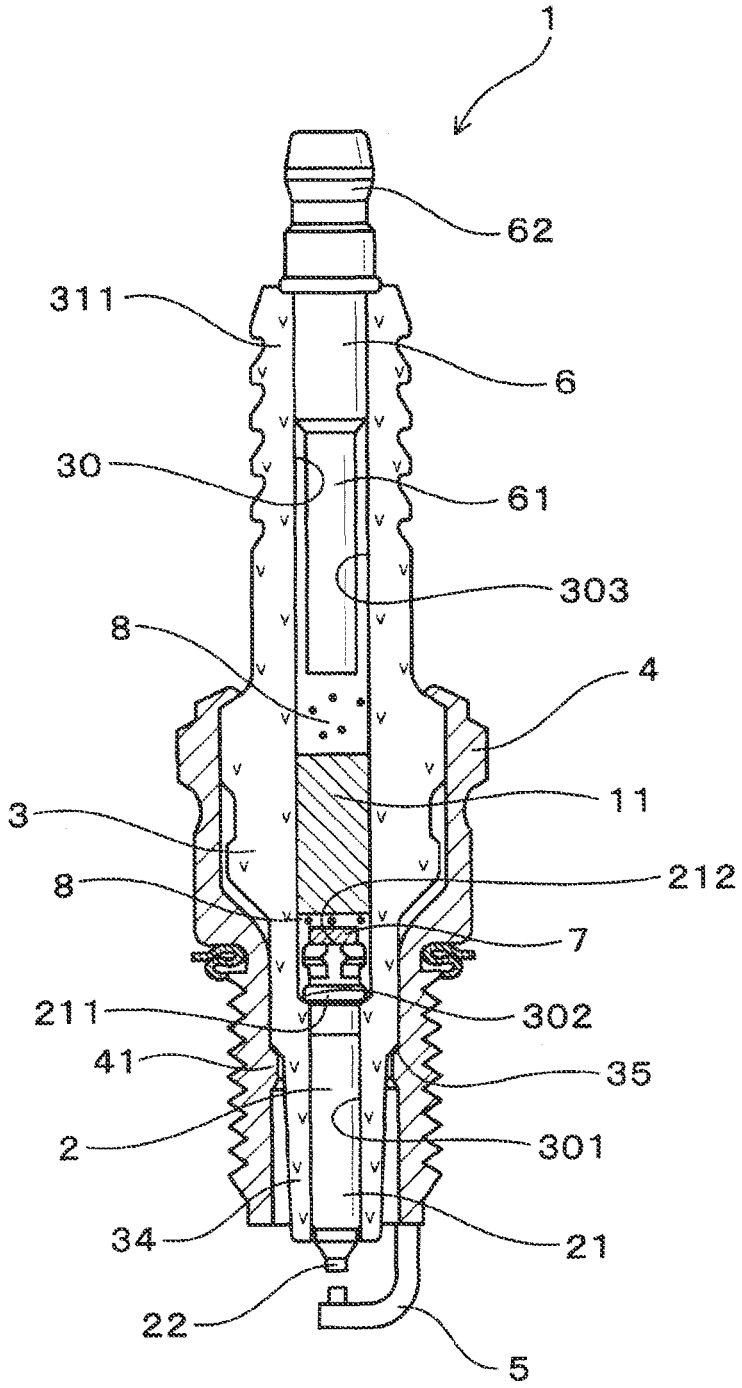
FIG. 4 is an elevation in section of a spark plug for an internal combustion engine according to a third embodiment of the invention.

Next, a third embodiment of the invention is described with reference to FIG. 4. As shown in FIG. 4, the third embodiment differs from the first embodiment in that the heat insulating member 7 is formed on the proximal end surface 212 of the center electrode 2. The heat insulating member 7 can be formed by coating the proximal end surface 212 of the center electrode 2 with a heat insulating material, for example. In this embodiment, the heat insulating member 7 is formed only in the proximal end surface 212 of the center electrode 2. However, the heat insulating member 7 may be formed also on the peripheral side of the center electrode 2.

The spark plug 1 according to the third embodiment can be manufactured easily with less man hours like the second embodiment. Other than the above, the third embodiment provides the same advantages as those provided by the first embodiment.

Fourth Embodiment

Figure 5:
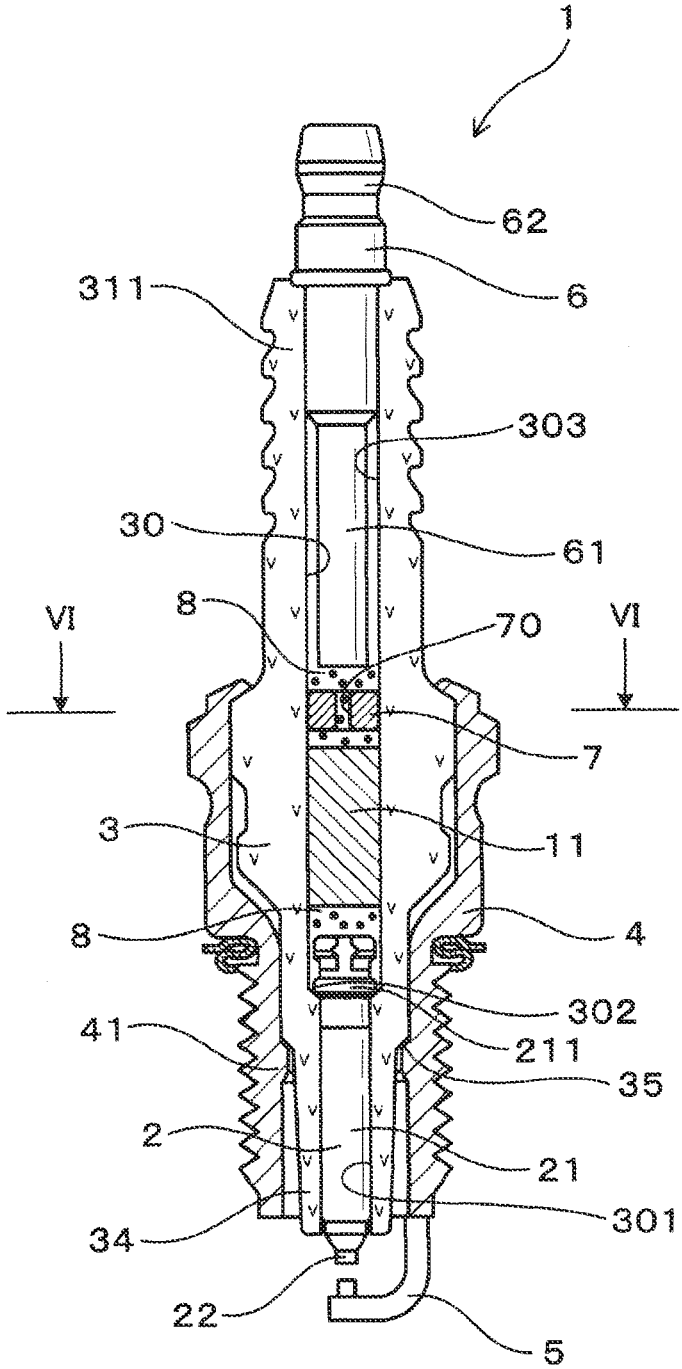
FIG. 5 is an elevation in section of a spark plug for an internal combustion engine according to a fourth embodiment of the invention.
Figure 6:
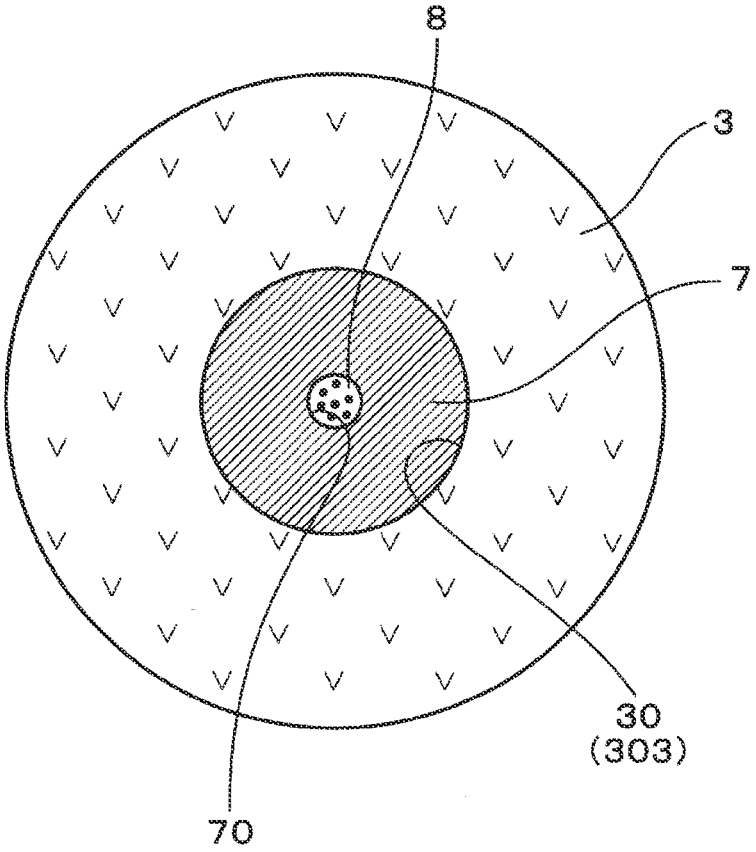
FIG. 6 is a cross-sectional view taken along line VI-VI of FIG. 5 excluding a housing.

Next, a fourth embodiment of the invention is described with reference to FIGS. 5 and 6. As shown in FIGS. 5 and 6, the fourth embodiment differs from the first embodiment in that the heat insulating member 7 is formed with a through hole 70 axially penetrating therethrough. The conductive member 8 is disposed inside the through hole 70 to ensure electrical connection between a portion of the conductive material 8 located at the distal side of the heat insulating member 7 and a portion of the conductive material 8 located at the proximal side of the heat insulating member 7. The diameter of the heat insulating member 7 is approximately the same as that of the axial hole 30 of the insulator 3. The heat insulating member 7 abuts on the inner periphery of the axial hole 30 of the insulator 3 throughout its circumference.

In the fourth embodiment, the stem 6 can be electrically connected to the center electrode 2 through the inside of the through hole 70 of the heat insulating member 7.

It is a matter of course that various modifications can be made to the above embodiments as described below. The spark plug 1 according to each of the first to fourth embodiments includes the resister 11. However, the resistor may be omitted. The heat insulating member may be disposed between the resistor and the center electrode instead of between the resistor and the stem. Further, the heat insulating member may be disposed between the resistor and the stem and between the resistor and the center electrode. Any two or more of the first to fourth embodiments may be combined where appropriate. For example, it is possible to combine the second and third embodiments where both the distal end surface of the stem body and the proximal end surface of the center electrode are coated with the heat insulating material.

The above explained preferred embodiments are exemplary of the invention of the present application which is described solely by the claims appended below. It should be understood that modifications of the preferred embodiments may be made as would occur to one of skill in the art.

What is claimed is:

1. A spark plug for an internal combustion engine comprising:

a center electrode;

an insulator holding the center electrode inserted therein;

a housing holding the insulator inserted therein;

a ground electrode joined to the housing so as to form a spark discharge gap with the center electrode; and a stem electrically connected to the center electrode, the stem including a stem body inserted and held inside the insulator and a terminal disposed at a proximal end of the stem body and exposed from a proximal end of the insulator;

wherein the insulator includes a supported portion axially supported by the housing;

a heat insulating member is interposed between the stem and the center electrode within the insulator, a conductive member is disposed inside the insulator so as to pass through the heat insulating member for making electrical connection between the stem and the center electrode, and the heat insulating member is located closer to a proximal side of the insulator than the supported portion is.

2. The spark plug for an internal combustion engine according to claim 1, wherein the heat insulating member is formed on a distal end surface of the stem body.

3. The spark plug for an internal combustion engine according to claim 1, wherein the heat insulating member is formed on a proximal end surface of the center electrode.

* * * * *